US009499751B2

(12) United States Patent
Martinie et al.

(10) Patent No.: US 9,499,751 B2
(45) Date of Patent: Nov. 22, 2016

(54) PROCESS FOR OXIDATIVE CONVERSION OF ORGANOSULFUR COMPOUNDS IN LIQUID HYDROCARBON MIXTURES

(71) Applicant: Saudi Arabian Oil Company, Dhahran (SA)

(72) Inventors: Gary D. Martinie, Graham, NC (US); Farhan M. Al-Shahrani, Dhahran (SA); Bashir O. Dabbousi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 89 days.

(21) Appl. No.: 14/247,384

(22) Filed: Apr. 8, 2014

(65) Prior Publication Data

US 2014/0299513 A1 Oct. 9, 2014

Related U.S. Application Data

(60) Division of application No. 12/824,907, filed on Jun. 28, 2010, now Pat. No. 8,715,489, which is a continuation-in-part of application No. 11/222,729, filed on Sep. 8, 2005, now Pat. No. 7,744,749.

(51) Int. Cl.
*C10G 53/14* (2006.01)
*C10G 27/00* (2006.01)

(52) U.S. Cl.
CPC ..... *C10G 53/14* (2013.01); *C10G 27/00* (2013.01); *C10G 2400/04* (2013.01)

(58) Field of Classification Search
None
See application file for complete search history.

(56) References Cited

U.S. PATENT DOCUMENTS

| | | | |
|---|---|---|---|
| 2,253,308 | A | 8/1941 | Rosen |
| 2,593,761 | A | 4/1952 | Johnstone |
| 2,671,049 | A | 3/1954 | Brown |
| 2,697,682 | A | 12/1954 | Porter |
| 2,834,717 | A | 5/1958 | Shiah |
| 3,284,342 | A | 11/1966 | Nathan et al. |
| 3,341,448 | A | 9/1967 | Ford et al. |
| 3,565,793 | A | 2/1971 | Herbstman et al. |

(Continued)

FOREIGN PATENT DOCUMENTS

| | | | |
|---|---|---|---|
| CN | 1534082 | A1 | 10/2004 |
| EP | 0565324 | A1 | 10/1993 |
| WO | 00/15734 | A1 | 3/2000 |

OTHER PUBLICATIONS

Avidan et al., "Sulphco-Desulfurization Via Selective Oxidation--Pilot Plant Results and Commercialization Plans," National Petrochemical & Refiners Association, Presented at the NPRA 2001 Annual Meeting, Mar. 18-20, 2001, pp. 1-10.

(Continued)

*Primary Examiner* — Tam M Nguyen
(74) *Attorney, Agent, or Firm* — Abelman, Frayne & Schwab

(57) ABSTRACT

The process for the desulfurization of a sulfur-containing hydrocarbon mixture, such as a full-range, hydrotreated diesel oil, is accomplished with an aqueous oxidizing agent in the presence of a catalyst and a co-catalyst, and thereafter selectively removing the oxidized compounds by solvent extraction. Optionally, the foregoing steps are followed by solvent stripping and recovery, and a final polishing step.

14 Claims, 2 Drawing Sheets

(56) References Cited

U.S. PATENT DOCUMENTS

| | | | |
|---|---|---|---|
| 3,595,778 | A | 7/1971 | Smetana et al. |
| 3,719,589 | A | 3/1973 | Herbstman et al. |
| 3,816,301 | A | 6/1974 | Sorgenti |
| 3,945,914 | A | 3/1976 | Yoo et al. |
| 4,088,569 | A | 5/1978 | Douglas |
| 4,562,276 | A | 12/1985 | Venturello et al. |
| 4,595,671 | A | 6/1986 | Venturello et al. |
| 4,607,113 | A | 8/1986 | Shum et al. |
| 4,731,482 | A | 3/1988 | Venturello et al. |
| 4,772,731 | A | 9/1988 | Shum et al. |
| 5,017,280 | A | 5/1991 | Paris-Marcano |
| 5,087,350 | A | 2/1992 | Paris-Marcano |
| 5,274,140 | A | 12/1993 | Venturello et al. |
| 5,310,479 | A | 5/1994 | Audeh |
| 5,324,849 | A | 6/1994 | Bonsignore et al. |
| 5,509,945 | A † | 4/1996 | Verkade |
| 5,547,563 | A | 8/1996 | Stowe |
| 5,780,655 | A | 7/1998 | Shum |
| 5,847,120 | A | 12/1998 | Collins et al. |
| 5,948,242 | A | 9/1999 | Ohsol et al. |
| 5,958,224 | A | 9/1999 | Ho et al. |
| 5,961,820 | A | 10/1999 | Jeanblanc et al. |
| 5,985,137 | A | 11/1999 | Ohsol et al. |
| 6,054,580 | A | 4/2000 | Collins et al. |
| 6,160,193 | A | 12/2000 | Gore |
| 6,171,478 | B1 | 1/2001 | Cabrera et al. |
| 6,274,785 | B1 | 8/2001 | Gore |
| 6,277,271 | B1 | 8/2001 | Kocal |
| 6,368,495 | B1 | 4/2002 | Kocal et al. |
| 6,402,938 | B1 | 6/2002 | Moore et al. |
| 6,402,939 | B1 † | 6/2002 | Yen |
| 6,402,940 | B1 | 6/2002 | Rappas |
| 6,406,616 | B1 | 6/2002 | Rappas et al. |
| 6,485,633 | B2 | 11/2002 | Wismann et al. |
| 6,500,219 | B1 | 12/2002 | Gunnerman |
| 6,503,471 | B1 | 1/2003 | Han et al. |
| 6,544,409 | B2 | 4/2003 | De Souza |
| 6,565,741 | B2 | 5/2003 | Wismann et al. |
| 6,596,914 | B2 † | 7/2003 | Gore |
| 6,638,419 | B1 | 10/2003 | Da Silva et al. |
| 6,652,992 | B1 | 11/2003 | Gunnerman |
| 6,673,236 | B2 | 1/2004 | Stanciulescu et al. |
| 7,314,545 | B2 | 1/2008 | Karas et al. |
| 2002/0029997 | A1 | 3/2002 | Rappas et al. |
| 2002/0035306 | A1 | 3/2002 | Gore et al. |
| 2002/0043482 | A1 | 4/2002 | Wismann et al. |
| 2002/0130062 | A1 | 9/2002 | Wismann et al. |
| 2002/0144932 | A1 | 10/2002 | Gong et al. |
| 2002/0148754 | A1 | 10/2002 | Gong et al. |
| 2002/0148756 | A1 | 10/2002 | Morris et al. |
| 2002/0189975 | A1 | 12/2002 | De Souza |
| 2003/0014911 | A1 | 1/2003 | Gunnerman |
| 2003/0051988 | A1 | 3/2003 | Gunnerman et al. |
| 2003/0075483 | A1 | 4/2003 | Stanciulescu et al. |
| 2003/0102252 | A1 | 6/2003 | Rabion et al. |
| 2003/0183555 | A1 | 10/2003 | Corma Canos et al. |
| 2004/0007501 | A1 | 1/2004 | Sughrue et al. |
| 2004/0007502 | A1 | 1/2004 | Wismann et al. |
| 2004/0035753 | A1 | 2/2004 | Cullen |
| 2004/0074812 | A1 | 4/2004 | Cullen |
| 2004/0079680 | A1 | 4/2004 | Gunnerman |
| 2004/0108252 | A1 | 6/2004 | De Souza |
| 2004/0118750 | A1 | 6/2004 | Gong et al. |
| 2004/0140247 | A1 | 7/2004 | Canos et al. |
| 2004/0154959 | A1 | 8/2004 | Schoebrechts et al. |
| 2004/0159583 | A1 | 8/2004 | Mesters et al. |
| 2004/0170553 | A1 | 9/2004 | Axon et al. |
| 2004/0178121 | A1 | 9/2004 | Leyshon et al. |
| 2004/0178122 | A1 | 9/2004 | Karas et al. |
| 2004/0200759 | A1 | 10/2004 | Cullen |
| 2004/0222131 | A1 | 11/2004 | Cullen |
| 2007/0051667 | A1 | 3/2007 | Martinie et al. |

OTHER PUBLICATIONS

Baker et al., "Hydroperoxide Oxidations Catalyzed by Metals. IV. Molybdenum Hexacarbonyl Catalyzed Epoxidation of 1-Octene," J. Org. Chem., vol. 38, No. 6, 1973, pp. 1145-1148.

Ballistreri et al., "Application of the Thianthrene 5-Oxide Mechanistic Probe to Peroxometal Complexes," J. Am. Chem. Soc. 1991, 133, pp. 6209-6212.

Ballistreri et al., "Rates and Mechanism of the Stoichiometri Oxidations of Organic Sulphides to Sulphoxides with the Peroxomolybdenum Complex MoO(O2)2HMPT," Journal of Molecular Catalysis, 50, 1989, pp. 39-44.

Ballistreri et al., "Reactivity of Peroxopolyoxo Complexes. Oxidation of Thioethers, Alkenes, and Sulfoxides by Tetrahexylammonium Tetrakis(diperoxomolybdo)phosphate," J. Org. Chem. 1992, 57, pp. 7074-7077.

Berkessel, Albrecht, "Biomimetic Oxidation of Organic Substrates with Hydrogen Peroxide," Contribution, Institut fur Organische Chemie der Universitat zu Koln, Griemstr. 4, D-50939 Koln, Germay; TCI Mail 109, 2001, pp. 1-11.

Bianchini et al., "Liquid-Biphase Hydrogenolysis of Benzo(b)thiophene by Rhodium Catalysis," J. Am. Chem. Soc., 1997, 119, pp. 4945-4954.

Bonchio et al., "The Relative Reactivity of Thioethers and Sulfoxides toward Oxygen Transfer Reagents: The Oxidation of Thianthrene 5-Oxide and Related Compounds by MoO5HMPT," J. Org. Chem., 1995, 60, pp. 4475-4480.

Bora et al., "Peroxometal-mediated environmentally favorable route to brominating agents and protocols for bromination of organics," Pure Appl. Chem., vol. 73, No. 1, 2001, pp. 93-102.

Botrel et al., "An experimental and theoretical investigation of the regioselective cleavage of aromatic sulfones," New J. Chem., 2000, 24, pp. 815-820.

Brauer et al., "Formation of singlet molecular oxygen by the Radziszewski reaction between acetonitrile and hydrogen peroxide in the absence and presence of ketones," J. Chem. Soc., Perkin Trans. 2, 2002, pp. 1288-1295.

Campos-Martin et al., "Highly efficient deep desulfurization of fuels by chemical oxidation," Green Chem., 2004, 6, pp. 557-562.

Collins et al., "Oxidative desulphurization of oils via hydrogen peroxide and heteropolyanion catalysis," Journal of Molecular Catalysis A: Chemical 117, 1997, pp. 397-403.

D'Alessandro et al., "Oxidation of dibenzothiophene by hydrogen peroxide or monopersulfate and metal-sulfophtalocyanine catalysts: an easy access to biphenylsultone or 2-(2'-hydroxybiphenyl)sulfonate under mild conditions," New J. Chem., 2003, 27, pp. 989-993.

Dishun et al., "A Review of Desulfurization of Light Oil Based on Selective Oxidation," http://www.chemistrymag.org/cji/2004/063017re.htm, Mar. 21, 2004, vol. 6, No. 3, pp. 17.

Gosling et al., "The Role of Oxidative Desulfurization in an Effective ULSD Strategy," National Petrochemical & Refiners Association, Annual Meeting, AM-04-48, Mar. 21-23, 2004, pp. 1-12.

Herbstman et al., "Oxidative Desulfurization of Residual Oils," Symposium on Upgrading of Synthetic Crudes Presented Before the Division of Petroleum Chemistry, Inc., American Chemical Society, Kansas City Meeting, Sep. 12-17, 1982; A.m. Chem. Soc., Div. Pet. Chem. (1982), 27(4), pp. 826-836.

Hu et al., "Catalysis by Heteropoly Compounds XXII. Reactions of Esters and Esterification Catalyzed by Heteropolyacids in a Homogeneous Liquid Phase—Effects of the Cnetral Atom of Heteropolyanions Having Tungsten as the Addenda Atom," Journal of Catalysis 143, 1993, pp. 437-448.

Ishihara et al., "Oxidative desulfurization and denitrogenation of a light gas oil using an oxidation/adsorption continuous flow process," Applied Catalysis A: General 279, 2005, pp. 279-287.

Laus, Gerhard, "Kinetics of acetonitrile-assisted oxidation of tertiary amines by hydrogen peroxide," J. Chem. Soc., Perkin Trans. 2, 2001, pp. 864-868.

Levy et al., "Unipure's Oxidative Desulfurization Process Creates New Market Opportunities for Supply of Ultra-Low Sulfur Fuels,"

(56) References Cited

OTHER PUBLICATIONS

UniPure Corporation, Prepared for Presentation at AIChE 2002 Spring Meeting, New Orleans, Mar. 13, 2002, Session on Non-Conventional Technology for Desulfurization, Paper No. 36c, pp. 1-8.
Ligtenbarg, Alette, "Vanadium and Iron Complexes for Catalytic Oxidation," Disertaion, University of Groningen, 2001, pp. 1-183.
Liotta et al., "Production of Ultra-Low Sulfur Fuels by Selective Hydroperoxide Oxidation," National Petrochemical & Refiners Assocation, Annual Meeting, AM-03-23, Mar. 23-25, 2003, pp. 1-11.
Martinie et al., "Investigation of the Wet Oxidation Efficiencies of Perchloric Acid Mixtures for Various Organic Substances and the Identities of Residual Matter," Analytical Chemistry, vol. 48, No. 1, Jan. 1976, pp. 70-74.
Murata et al., "A Novel Oxidative Desulfurization System for Diesel Fuels with Molecular Oxygen in the Presence of Cobalt Catalysts and Aldehydes," Energy & Fuels 2004, 18, pp. 116-121.
Nizova et al., "Catalytic oxidation of methane to methyl hydroperoxide and other oxygenates under mild conditions," Chem. Commun., 1997, pp. 397-398.
Oh et al., "The Remote Activation of Chemical Bonds via Metal Coordination," Advanced Synthesis & Catalysis; vol. 345 Issue 9-10, 2003, pp. 1053-1060.
Raja et al., "New catalysts for the aerobic selective oxidation of hydrocarbons: Mn(III)- and Co(III)-containing molecular sieves for the epoxidation of alkenes," Chem. Commun., 1999, pp. 829-830.
Ramirez-Verduzco et al., "Desulfurization of Middle Distillates by Oxidation and Extraction Process," Petroleum Science and Technology, vol. 22, Nos. 1 & 2, 2004, pp. 129-139.
Research & Development Update, "Catalyst Helps Destroy Toxic Pollutants," CEP, www.cepmagazine.org, Nov. 2003, pp. 15-17.
Schilt et al., "Determination of Acetates and Acetyl Groups by Digestion of Samples in Perchloric Acid Followed by Either Nuclear Magnetic Resonance Spectrometry or Distillation and Potentiometric Titration," Analytical Chemistry, vol. 48, No. 2, Feb. 1978, pp. 447-450.
Shiraishi et al., "A Deep Desulfurization Process for Light Oil by Photosensitized Oxidation Using a Triplet Photosensitizer and Hydrogen Peroxide in an Oil/Water Two-Phase Liquid-Liquid Extraction System," Ind. Eng. Chem. Res., 1999, 38, pp. 1589-1595.
Shiraishi et al., "Desulfurization of Vacuum Gas Oil Based on Chemical Oxidation Followed by Liquid-Liquid Extraction," Energy & Fuels, 2004, 18, pp. 37-40.
Shiraishi et al., "Photochemical Production of Biphenyls from Oxidized Sulfur Compounds Obtained by Oxidative Desulfurization of Light Oils," Energy & Fuels, 2003, 17, pp. 95-100.
Taube, Fabian, "Characterization of Aqueous Peroxomolybdates with Catalytic Applicability," Disertation, Umea University, 2002, pp. 1-73.
Te et al., "Oxidation reactivities of dibenzothiophenes in poloxometalate/H2O2 and formic acid/H2O2 systems," Applied Catalysis A: General 219, 2001, pp. 267-280.
Venturello et al., "A new peroxotungsten heteropoly anion with special oxidizing properties: synthesis and structure of tetrahexylammonium tetra(diperoxotungsto)phosphate (3-)," abstract from J. Mol. Catal., 32(1), 107-10, p. 1 (Chem. Abst, 104,27804z(1986)).
Venturello et al., "A New, Effective Catalytic System for Epoxidation of Olefins by Hydrogen Peroxide under Phase-Transfer Conditions," J. Org. Chem., 1983, 48, pp. 3831-3833.
Yazu et al., "Tungstophosphoric Acid-catalyzed Oxidative Desulfurization of Light Oil with Hydrogen Peroxide in a Light Oil/Acetic Acid Biphasic System," Chemistry Letters, vol. 32, No. 10, 2003, pp. 920-921.
Yu et al., "Oxidative Desulfurization of Diesel Fuels with Hydrogen Peroxide in the Presence of Activated Carbon and Formic Acid," Energy & Fuels, 2005, 19, pp. 447-452.
Zapata et al., "Catalyst screening for oxidative desulfurization using hydrogen peroxide," Catalysis Today, 106, 2005, pp. 219-221.
International Search Report mailed on Feb. 15, 2008 by the ISA/US in application No. PCT/US06/29574, pp. 1-3.
Vasile Hulea, Mild Oxidation with H2O2 over Ti-Containing Molecular Sieves—A very Efficient Method for Removing Aromatic Sulfur Compounds from Fuels, 179-186, 2001, Journal of Catalysis, 198, Academic Press.†
Nicola d'Alessandro, Oxidation of dibenzothiophene by hydrogen peroxide or monopersulfate and metal-sulfophthalocyanine catalysts: an easy access to biphenylsultone or 2-(2'-hydroxybiphenyl) sulfonate under mild conditions, 989-993, 2003, New J. Chem., 27, Royal Soc. of Chem.†
Mario J. Nappa, Steric and Electronic Control of Iron Porphyrin Catalyzed Hydrocarbon Oxidations, 4711-4719, 1985, lnorg. Chem., 24, Am. Chem. Soc.†
Mure Te, Oxidation reactivities of dibenzothiophenes in polyoxometalate/H2O2 and formic acid/H2O2 systems, 267-280, 2001, Applied Catalysis A: General 219, Elsevier Science B.V.†

† cited by third party

PROCESS FOR OXIDATIVE CONVERSION OF ORGANOSULFUR COMPOUNDS IN LIQUID HYDROCARBON MIXTURES

RELATED APPLICATIONS

The present application is a Divisional of U.S. application Ser. No. 12/824,907, now U.S. Pat. No. 8,715,489, which is a Continuation-in-Part of U.S. application Ser. No. 11/222,729 filed on Sep. 8, 2005, now U.S. Pat. No. 7,744,749, and entitled "Diesel Oil Desulfurization by Oxidation and Extraction," which are both incorporated herein by reference.

TECHNICAL FIELD

This invention is directed to the conversion of organosulfur compounds in liquid hydrocarbon mixtures and, more particularly, their conversion by catalytic oxidation.

BACKGROUND ART

The removal of sulfur compounds from petroleum streams has been of considerable importance in the past and is even more so today due to environmental considerations. Gas effluent from the combustion of organic materials, such as coal, almost always contain sulfur compounds and sulfur removal processes have concentrated on removing hydrogen sulfide since it has been considered a significant health hazard and also because it is corrosive, particularly when water is present. With increasing emphasis on eliminating or minimizing sulfur discharge to the atmosphere, attention is turning to the removal of other sulfur compounds from gas streams.

The removal of sulfur compounds and particularly chemically-combined sulfur, such as organosulfur compounds, from feedstreams is highly desirable to meet environmental concerns and to prevent potential catalyst deactivation as well as equipment corrosion.

Typically, hydrocarbon products contain various amounts of sulfur compounds in the form of, for example, chemically-combined sulfur, such as inorganically combined sulfur and organically combined sulfur, i.e., organosulfur compounds.

The presence of organosulfur compounds in hydrocarbon streams results naturally, as well as from the introduction of organosulfur compounds into the hydrogen streams during conventional processes for producing and treating hydrocarbon products.

As previously indicated, if chemically-combined sulfur, such as organosulfur compounds, are not removed from the hydrocarbon streams, the presence of organosulfur compounds in the resultant hydrocarbon products, including natural gas, paraffins, olefins and aromatics, particularly gasoline, diesel or other fuels, can cause corrosion of processing equipment and engine parts, as well as other deleterious effects, particularly when water is present.

Oxidative desulfurization research for diesel and other oil streams has been ongoing for over 100 years. The following table summarizes patents granted from 1941 to 1976 directed to oxidative desulfurization.

| Patent No. | Inventor | Assignee | Title |
|---|---|---|---|
| 2,253,308 Aug. 19, 1941 | Rosen, Raphael | Standard Catalytic | Desulfurization of Hydrocarbons |

-continued

| Patent No. | Inventor | Assignee | Title |
|---|---|---|---|
| 2,697,682 Dec. 21, 1954 | Porter, Fredrich | Anglo-Iranian Oil | Catalytic Desulfurization of Petroleum Hydrocarbons |
| 2,671,049 Mar. 2, 1954 | Brown, Russell | Standard Oil | Odor Improvement of Petroleum Oils |
| 2,834,717 May 13, 1958 | Shiah, Chyn | | Process of Desulfurizing Hydrocarbons with a Boron Fluoride |
| 3,284,342 Nov. 8, 1966 | Nathan, Wilfred | British Petroleum | Desulfurization of Hydrocarbon Materials |
| 3,341,448 Sep. 12, 1967 | Ford, John | British Petroleum | Desulfurization of Hydrocarbons Oxidative Hydro-Treatments |
| 3,565,793 Feb. 23, 1971 | Herbstman, Sheldon | Texaco, Inc. | Desulfurization With a Catalytic Oxidation Step |
| 3,595,778 Jul. 27, 1971 | Smetana, Richard | Texaco, Inc. | Desulfurization Process Including an Oxidation Step |
| 3,719,589 Mar. 6, 1973 | Herbstman, Sheldon | Texaco, Inc. | Asphalt Separation in De-Sulfurization with an Oxidative Step |
| 3,816,301 Jun. 11, 1974 | Sorgenti, Harold | Atlantic Richfield | Process for the Desulfurization of Hydrocarbons |
| 3,945,914 Mar. 23, 1976 | Yoo, Jim | Atlantic Richfield | Process of Sulfur Reduction of an Oxidized Hydrocarbon |

Paris-Marcano U.S. Pat. Nos. 5,017,280 and 5,087,350 disclose oxidative desulfurization of petroleum using nitric acid with hydrogen peroxide. Gore U.S. Pat. Nos. 6,274,785 and 6,160,193 disclose oxidative desulfurization Cabrerra U.S. Pat. No. 6,171,478 discloses a complex oxidative desulfurization patent. Rappas U.S. Pat. Nos. 6,402,940 and 6,406,616 disclose oxidative desulfurization using performic acid; and Ohsohl U.S. Pat. Nos. 5,985,137 and 5,948,242 disclose desulfurization of crude oil.

Jeanblanc PCT Patent Publication WO 00/15734 discloses radiative assisted oxidative desulfurization. Sulfur-containing carbonaceous materials are desulfurized by reaction with a mixture of an oxidizing agent and an oxygenated solvent such as diethyl ether under alkaline conditions at a temperature preferably ranging from ambient temperature to about 121° C. and pressure of about 1 to 2 atmospheres. The use of radiation—such as X-ray, infrared, visible microwave, or ultraviolet radiation, alpha, beta or gamma radiation, other atomic radiation emanating from a radioactive material, or ultrasound—facilitates desulfurization. The products of the reaction are a desulfurized carbonaceous material in which the sulfur content is (for example) less than about 1% and separated sulfur compounds.

Yen U.S. Pat. No. 6,402,939 discloses ultrasonic assisted oxidative desulfurization. Gunnerman U.S. Pat. Nos. 6,500,219 and 6,652,592 and Stowe U.S. Pat. No. 5,547,563 also disclose ultrasonic assisted oxidative desulfurization.

Cullen US Patent Publications 2004/0200759, 2004/0222131, 2004.0074812 and U.S. Pat. No. 7,081,196 disclose oxidative, reactive, ultrasonic desulfurization processes.

Collins U.S. Pat. Nos. 5,847,120 and 6,054,580 disclose tetraamidomacriocyclic ligand complexes of iron as homogeneous oxidation catalysts to promote peroxide oxidations. The complex provides a stable, long-lived oxidation catalyst or catalyst activator.

Kocal U.S. Pat. No. 6,277,271 discloses a process for the desulfurization of a hydrocarbonaceous oil in which hydrocarbonaceous oil and a recycle stream containing sulfur-oxidated compounds are contacted with a hydrodesulfurization catalyst in a hydrodesulfurization reaction zone to reduce the sulfur level to a relatively low level. The resulting hydrocarbonaceous stream from the hydrodesulfurization zone is contacted with an oxidizing agent to convert the residual, low level of sulfur compounds into sulfur-oxidated compounds. The residual oxidizing agent is decomposed and the resulting hydrocarbonaceous oil stream containing the sulfur-oxidated compounds is separated to produce a stream containing the sulfur-oxidated compounds and a hydrocarbonaceous oil stream having a reduced concentration of sulfur-oxidated compounds. At least a portion of the sulfur-oxidated compounds is recycled to the hydrodesulfurization reaction zone.

Kocal U.S. Pat. No. 6,368,495 discloses removal of sulfur-containing compounds from liquid hydrocarbon streams using hydrogen peroxide and air, with heterogeneous transition metal catalysts. The process more specifically addresses the removal of thiophenes and thiophene derivatives from a number of petroleum fractions, including gasoline, diesel fuel, and kerosene. In the first step of the process, the liquid hydrocarbon is subjected to oxidation conditions in order to oxidize at least some of the thiophene compounds to sulfones. Then, these sulfones can be catalytically decomposed to hydrocarbons (e.g. hydroxybiphenyl) and volatile sulfur compounds (e.g., sulfur dioxide). The hydrocarbon decomposition products remain in the treated liquid as valuable blending components, while the volatile sulfur compounds are easily separable from the treated liquid using well-known techniques such as flash vaporization or distillation.

Cabrera U.S. Pat. No. 6,171,478 discloses desulfurization of a hydrocarbonaceous oil in which the oil is contacted with a hydrodesulfurization catalyst in a hydrodesulfurization reaction zone to reduce the sulfur level to a relatively low level and then contacting the resulting stream from the desulfurization zone with an oxidizing agent to convert the residual, low level of sulfur compounds into sulfur-oxidated compounds. The resulting oil stream containing the sulfur-oxidated compounds is separated after decomposing any residual oxidizing agent to produce a stream containing the sulfur-oxidated compounds and an oil stream having a reduced concentration of sulfur-oxidated compounds.

Shum U.S. Pat. No. 4,772,731 discloses the epoxidation of olefins with molybdenum dioxo dialkyleneglycolate compositions. Molybdenum dioxo dialkyleneglycolate compositions are produced by reaction of molybdenum trioxide with particular dialkylene glycol compounds at specified elevated temperatures while removing water. These compounds are described as being useful as catalysts in the epoxidation of olefinic compounds with an organic hydroperoxide.

Shum U.S. Pat. No. 5,780,655 discloses an epoxidation process using an alkylammonium phosphate-stabilized peroxotungstate compound as catalyst. Olefins are selectively converted to epoxides using hydrogen peroxide as oxidant in a single liquid phase reaction system characterized by a liquid phase comprised predominantly of an organic solvent. The reaction is catalyzed by a compound comprised of a phosphate-stabilized peroxotungstate species having a W:P atomic ratio of 2:1. This disclosure pertains to methods of converting olefins to epoxides in a single liquid phase using hydrogen peroxide and a catalyst in salt or acid form comprising a species corresponding to $(R_4N)_2PW_2O_{13}(OH)$.

Venturello U.S. Pat. No. 5,274,140 discloses a process for olefin epoxidation by reaction with hydrogen peroxide according to a double phase technique (i.e., a biphasic reaction system containing both an aqueous phase and an organic phase). The catalyst system consists of a first component which is at least one element selected from W, Mo, V or a derivative thereof and a second component which is at least one derivative selected from the derivatives of P and As. The mutual atomic ratio of the catalyst components is between 12 and 0.1, but preferably is between 1.5 and 0.25.

Venturello U.S. Pat. Nos. 4,562,276 and 4,595,671 describe epoxidation catalysts for olefinic compounds, both in a homogeneous aqueous phase as well as in a heterogeneous phase. The catalysts correspond to the formula $Q_3XW_4O_{24}^{-2n}$ wherein Q represents a cation of an anionic salt, X is either P or As, while n=0, 1, or 2. The atomic ratio of W:P, where X=P, thus must be 4. The use of such compositions in an epoxidation wherein the reactants are maintained in a single substantially organic phase is not disclosed.

Bonsignore U.S. Pat. No. 5,324,849 discloses a class of compounds based on tungsten and diphosphonic acids which contain active oxygen atoms and cationic groups derived from onium salts. Such compounds are said to catalyze olefin oxidation reactions in double phase reaction systems containing both an organic phase and an aqueous phase. The compounds contain two phosphorus atoms and five tungsten atoms and thus have a W:P atomic ratio of 5:2.

However, the biphasic reaction systems of the type described in the aforementioned patents have a number of disadvantages which limit their usefulness in large scale commercial practice. Thus, there is a need to develop active catalysts capable of providing high selectivity to organosulfur compounds during oxidative desulfurization processes.

SUMMARY OF THE INVENTION

The process of the present invention is directed to the desulfurization of a hydrocarbon mixture, such as a full-range, hydrotreated diesel oil, with an aqueous oxidizing agent in the presence of a cage structure catalyst and a co-catalyst, and thereafter selectively removing the oxidized compounds by solvent extraction. Optionally, the foregoing steps are followed by solvent stripping and solvent recovery for reuse, and by a final polishing step.

BRIEF DESCRIPTION OF THE FIGURES

The invention will be described in further detail below and with reference to the attached drawings in which the same or similar elements are referred to by the same number, and where.

DETAILED DESCRIPTION OF THE INVENTION

Figure 1:
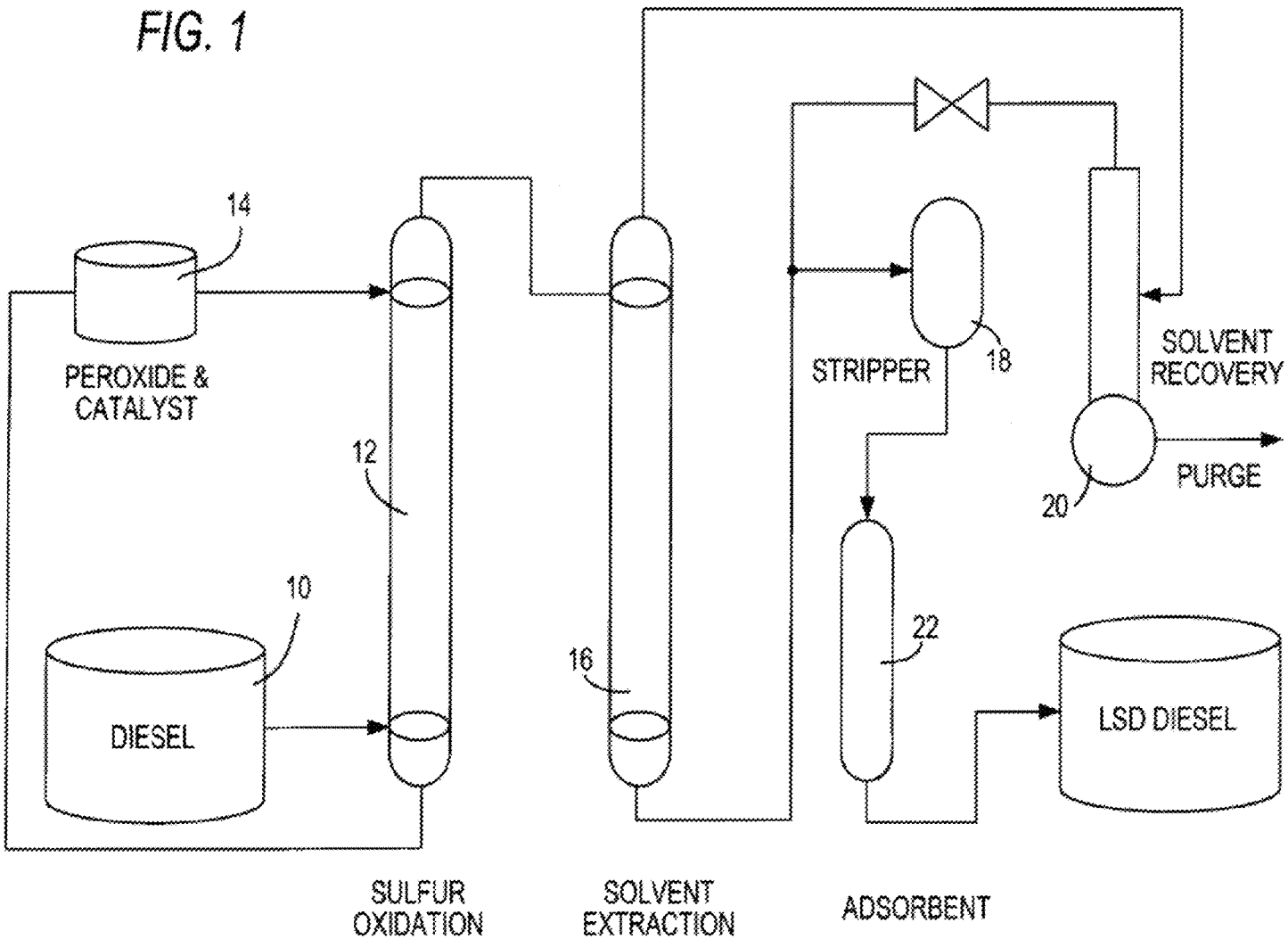
FIG. 1 is a schematic drawing of the process of the present invention.

Referring to FIG. 1, hydrotreated diesel containing organosulfur compounds in storage tank 10 is fed into reactor column 12 where it is subjected to continuous oxidation by reaction with an aqueous oxidant and a complex catalyst which is fed into the top of column 12 from a storage tank 14. The reaction operates under biphasic conditions, i.e., a first liquid phase of the hydrocarbon mixture such as hydrotreated diesel and a second liquid phase of the aqueous oxidant. The aqueous oxidant can be, for example, hydrogen peroxide, sodium hypochlorite or sodium peroxysulfate which is catalyzed by a complex catalyst according to the present invention, followed by a continuous liquid-liquid extraction of the diesel oil by a mixture of water and a polar solvent.

While certain embodiments of the process are described with reference to desulfurization of full range hydrotreated diesel oil with a boiling point in the range of about 240° C. to about 360° C., one of ordinary skill in the art will appreciate that other liquid organosulfur-containing hydrocarbon mixtures can be treated using the process described below.

The process includes treating a full range hydrotreated diesel oil in a countercurrent or a stirred tank reactor with an aqueous solution of hydrogen peroxide, in the presence of a catalyst and a co-catalyst, also known as a phase transfer agent. This action results in effecting the oxidation of the sulfur species that is present in the hydrotreated diesel at a nominal level of up to 1000 ppm w/w of total sulfur. The sulfur species present are oxidized to their corresponding sulfoxides, sulfones, sultines, sultones, sulfonates, sulfinates, or even to sulfur dioxide and sulfur trioxide and sulfite and sulfate.

The catalysts employed can be selected from a number of homogeneous or heterogeneous oxidation catalysts. Preferred catalysts according to certain embodiments of the present invention include cage structures, and in particular polyoxometalate structures including three or more transition metal oxyanions linked together by shared oxygen atoms to form a large, closed 3-dimensional framework. In addition, certain polyoxometalates can form complexes with surfactants, cations or anions such as tetraalkyl ammonium cations, phosphonate anions, and polyether nonionics, and are known as modified polyoxometalates. Preferred catalysts according to additional embodiments include porphyrins, chelates or clathrates.

Examples of suitable polyoxometalate structures are described herein. The Lindqvist structure is an iso-polyoxometalate, and has no heteroatom. Three other known structures are hetero-polyoxometalates, including Keggin and Dawson structures, which both have tetrahedrally coordinated hetero-atoms, such as P or Si, and Anderson structures which has an octahedral central atom, such as aluminum.

Figure 2:
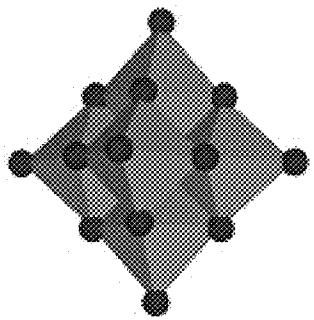
FIG. 2 is a depiction of a three-dimensional structural formula for a Lindqvist structure.

Lindqvist structures are iso-polyoxometalate structures, for instance, having the general formula $M_6O_{19}^{n-}$. A representative Lindqvist structure is depicted in FIG. 2. Lindvquist iso-polyoxometalates do not contain a heteroatom, and the structures consist of six octahedra of $MO_6$ arranged in an octahedron, in which M, the addenda atoms, can be tungsten, molybdenum, iron, titanium, nickel or others selected from D-Block elements from Groups 3-12 of the Periodic Table of the Elements. An example of a modified Lindqvist structure, triphosphono-polyperoxotungstate, was prepared and effectively used for the oxidation of benzothiophenes and dibenzothiophenes to their respective sulfones, as described in Example 4 below. Other exemplary Lindqvist structures or modified Lindqvist structures suitable for use as cage structure catalysts according to the present invention include, but are not limited to, certain Campos-Martin catalysts, certain tetraalkylammonim polyoxometallates, certain quaternary ammonium salts of polyoxometallates, certain poly oxy metalates and triphosphono-polyperoxotungstate.

Figure 3:
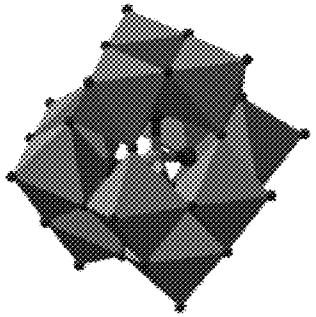
FIG. 3 is a depiction of a structural formula for a Keggin structure.

Keggin structures are hetero-polyoxometalates having tetrahedrally coordinated hetero-atoms, for instance, having the general formula $XM_{12}O_{40}^{n-}$. A representative Keggin structure is depicted in FIG. 3. Keggin structures are typically formed from a heteroatom oxide such as phosphate, $PO_4^{3-}$, tetrahedrally coordinated to and surrounded by 12 transition metal oxide $MO_3$ clusters, in which M, the addenda atoms, can be tungsten, molybdenum, vanadium, iron cobalt, or others selected from D-Block elements from Groups 3-12 of the Periodic Table of the Elements. The hetero-atoms are typically P-Block elements from Groups 13-17 of the Periodic Table of the Elements. According to the present invention, useful hetero-atoms in Keggin structures include, but are not limited to, phosphorous, silicon, germanium, arsenic, aluminum, antimony, chlorine, boron, sulfur, arsenic, antimony, and bismuth. Examples of Keggin structures, modified tetraoctyl-ammonium phosphotungstate and dodecamolybdophosphoric acid, were prepared and effectively used for the oxidation of sulfur compounds to sulfones, as described in Examples 1 and 3 below. Other exemplary Keggin structures or modified Keggin structures suitable for use as cage structure catalysts according to the present invention include, but are not limited to, certain Venturello catalysts, Mere Te catalysts, certain tetraalkylammonim polyoxometallates, certain quaternary ammonium salts of polyoxometallates, certain poly oxy metalates and phosphomolybdic acid.

Figure 4:
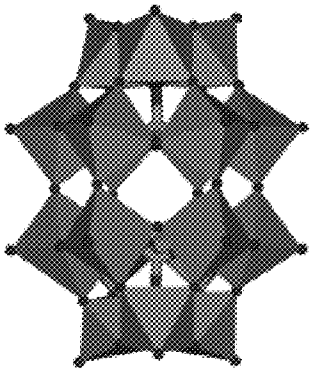
FIG. 4 is a depiction of a structural formula for a Dawson structure.

Dawson structures are hetero-polyoxometalates having tetrahedrally coordinated hetero-atoms, for instance, having the general formula such as $X_2M_{18}O_{62}^{n-}$. A representative Dawson structure is depicted in FIG. 4. Dawson structures are formed from lacunary Keggin ions, where 3 $MO_3$ units have been removed from the Keggin structure, and two of these lacunary Keggin ions are joined together, yielding two heteroatoms with $XO_4$ oxides, and 18 $MO_3$ units. In Dawson structures, the addenda atoms, M, can be tungsten, molybdenum, vanadium, iron cobalt, or others selected from D-Block elements from Groups 3-12 of the Periodic Table of the Elements. The hetero-atoms are typically P-Block elements from Groups 13-17 of the Periodic Table of the Elements. In additional embodiments, the hetero-atoms can also include certain D-Block elements from Groups 3-12 of the Periodic Table of the Elements, or F-Block Transition elements, i.e., lanthanides or actinides. According to the present invention, useful hetero-atoms in Dawson structures include, but are not limited to, molybdenum, tungsten, rhenium, iodine, uranium, phosphorous, silicon, germanium, arsenic, aluminum, antimony. chlorine, boron, sulfur, arsenic, and bismuth. An example of a Dawson structure, modified molybdotungstic phosphonate, was prepared and effectively used for the oxidation of sulfur compounds to sulfones, as described in Example 2 below. Other exemplary Dawson structures or modified Dawson structures suitable for use as cage structure catalysts according to the present invention include, but are not limited to, certain Bonsignore catalysts, certain tetraalkylammonim polyoxometallates, certain quaternary ammonium salts of polyoxometallates, certain poly oxy metalates and molybdotungstate.

Figure 5:
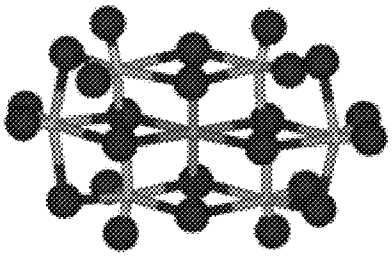
FIG. 5 is a depiction of a structural formula for a Anderson structure.

Anderson structures are hetero-polyoxometalates having an octahedral central atom, for instance, having the general formula such as $XM_6O_2^{n-}$. A representative Anderson structure is depicted in FIG. 5. In Anderson structures, the addenda atoms, M, can be tungsten, molybdenum, vanadium, iron cobalt, or others selected from D-Block elements from Groups 3-12 of the Periodic Table of the Elements. The heteroatoms are typically P-Block Elements from Groups 13-17 of the Periodic Table of the Elements. In additional embodiments, the hetero-atoms can also include certain D-Block elements from Groups 3-12 of the Periodic Table of the Elements, or F-Block Transition elements, i.e., lanthanides or actinides. An example of an Anderson structure, bismuthomolybdic acid, was prepared and effectively used for the oxidation of sulfur compounds to sulfones, as described in Example 5 below. Other exemplary Anderson structures or modified Anderson structures suitable for use as cage structure catalysts according to the present invention include, but are not limited to, certain Changwen Hu catalysts, certain tetraalkylammonim polyoxometallates, certain quaternary ammonium salts of polyoxometallates, certain poly oxy metalates and bismuthomolybdates.

Figure 6:
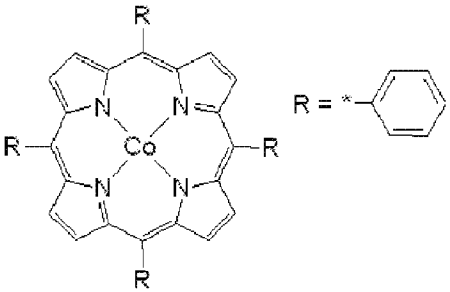
FIG. 6 is a depiction of a structural formula for a substituted porphyrin compound.

In additional embodiments of the present invention, porphyrin molecules having a substituted central metal atom, which are essentially two-dimensional cage molecular structures, are selected as oxidation catalysts. Porphyrin compounds are organic nitrogen compounds having four pyrorole rings together with four nitrogen atoms and two replaceable hydrogens, for which various transition metal atoms can be readily substituted. The substituted transition metal can be selected from D-Block elements of Groups 3-12 of the Periodic Table of the Elements, or F-Block Transition elements, i.e., lanthanides or actinides FIG. 6 shows a structural formula for a planar cage molecular structure having cobalt as the substituted transition metal. An example of a porphyrin compound, sodium sulfophthalocyanine 5 cobalt peroxide, was prepared and effectively used for the oxidation of sulfur compounds to sulfones, as described in Example 6 below. Other exemplary porphyin compounds suitable for use as cage structure catalysts according to the present invention include, but are not limited to, tetraalkylammonim metal sulfotetraphenylporphyrin, transition metal tetraphenylporphyrins, Merox catalysts and sodium sulfophthalocyanine cobalt peroxide.

Figure 7:
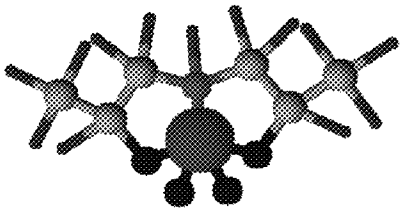
FIG. 7 is a depiction of a representative structural formula for a chelate compound.

In further embodiments, chelate structures are used as the structure catalysts according to the present invention. Chelates are cage-like chemical compound composed of a metal ion and a chelating agent. A chelating agent is a substance whose molecules can form several bonds to a single metal ion, in the form of a multidentate ligand. Chelates are cage like multiple bonded compounds formed between a metal ion and an organic binding agent. Chelation is the formation or presence of two or more separate bindings between a polydentate, i.e., many teeth or multiple bonded, ligand and a single central atom, typically a metal ion. These ligands, usually organic compounds, and are known as chelants, chelators, chelating agents, or sequestering agents. The ligand forms a chelate complex with the substrate. Chelate complexes are contrasted with coordination complexes with monodentate ligands, which form only one bond with the central atom. Chelants are chemicals that form soluble, complex molecules with certain metal ions, inactivating the ions so that they cannot easily react with other elements or ions to produce precipitates or scale. FIG. 7 shows a structural formula for the chelate structure aminodiisopropanol dioxo-molybdenum chelate. Other exemplary chelate structures suitable for use as cage structure catalysts according to the present invention include, but are not limited to, tetraamidomacrocylic iron complexes, dioxomolybdenum diglycolate, transition metal acetylacetonates, dioxomolybdenum aminodiglycolate, and certain Collins-Horwitz catalysts.

In additional embodiments, clathrate compounds are used as the structure catalysts according to the present invention. Clathrate compounds are include a lattice of one type of molecule trapping and containing a second type of molecule. Clathrates are a class of crystalline compounds formed from two different stable compounds that exhibit no covalent bond between them. A clathrate can be obtained when one compound, the host, crystallizes in such a way that holes or cavities within the lattice trap a second compound, the guest. This structure including the host matrix trapping a guest molecule can easily be extended from solid to liquid phases. Exemplary clathrate structures suitable for use as cage structure catalysts according to the present invention include, but are not limited to, tetraamidomacriocyclic ligand complexes of iron and certain Collins-Horwitz catalysts.

In order to facilitate the biphasic reaction, co-catalysts are employed to enhance and accelerate reactions which though favored thermodynamically, are very slow due to mass transfer factors. They may be anionic, cationic and nonionic. In certain embodiments, cationic phase transfer agents are preferred. The co-catalyst in certain embodiments can be the quaternary amine salt used in the synthesis. These salts do not always have to be pre-formed prior to the reaction, but may be formed in-situ by adding the transition metal salt or acid and then adding to the same solvent system, for example, aqueous peroxide, the phase transfer agent, such as a quaternary ammonium halide. Representative phase transfer agents are methyltrioctyl-ammonium bromide, cetyltrimethylammonium bromide, tetrabutyl ammonium chloride, tetradecyl pyridium chloride, and tetradecyl pyridinium bromide. Other cationic, anionic or nonionic.

The oxidation reaction can be conducted in a countercurrent reactor 12, which may be static, stirred, agitated with oscillating or rotating discs, at a temperature between 50° C. to 150° C. preferably between about 70° C. and about 110° C. Raffinate from the oxidation which contains residual catalyst, and spent or residual oxidant, is recycled to the oxidant-catalyst storage tank 14, where make-up catalyst and oxidant are added as required.

The concentration of the catalysts can be between about 0.001 and about 1.00 weight % based upon of the total oxidant usage, and preferably between about 0.01 and about 0.10 weight %. Oxidant concentrations can vary between about 1% and about 100%, by weight, but are typically between about 10% and about 50%, and in the case of hydrogen peroxide are preferably between about 15% and about 30%, by weight, in the aqueous phase. Oxidants vary by chemical type, oxidation potential, efficacy, stability and solubility and one of ordinary skill in the art can readily establish the useful and effective concentrations of oxidant. Oxidants which can be used in the present process include hydrogen peroxide, sodium hypchlorite, sodium or potassium peroxydisulfate or peroxymonosulfate, t-butyl hydroperoxide, perchloric acid, nitric acid, sulfuric acid, performic acid, and mixtures thereof.

The second step of the process involves the removal of the oxidized compounds by contacting the distillate with a selective extraction solvent in column 16. As reported in the literature concerning the ODS process, a liquid-liquid extraction technique using water-soluble polar solvents, such as DMSO, DMF, methanol, and acetonitrile, is commonly employed. DMSO and DMF have a high extractability for sulfones, but have a high boiling point which is close to the boiling point of the sulfones, and thus they may not be reused for further extraction based on recovery by distillation. Methanol and acetonitrile are preferred for use as the extraction solvent, since both have relatively low boiling points and are separated easily from the sulfones and other oxidized sulfur species by distillation. When methanol and acetonitrile are contacted with light oil, a large quantity of aromatics are extracted simultaneously with the sulfones. The addition of water, however, suppresses the extraction of the aromatics. Examples of polar solvents include those with high values of the Hildebrand solubility parameter Δ; liquids with a Δ higher than about 22 have been successfully used to extract the sulfur compounds. Examples of polar liquids and their Hildebrand values are shown in the Table below.

| Solvent | Hildebrand Value |
|---|---|
| Acetone | 19.7 |
| Butyl Cellosolve | 20.2 |
| Carbon disulfide | 20.5 |
| Pyridine | 21.7 |
| Cellosolve | 21.9 |
| DMF | 24.7 |
| n-Propanol | 24.9 |
| Ethanol | 26.2 |
| DMSO | 26.4 |
| n-Butyl alcohol | 28.7 |
| Acetonitrile | 30.0 |
| Methanol | 29.7 |
| Propylene glycol | 30.7 |
| Ethylene Glycol | 34.9 |
| Glycerol | 36.2 |
| Water | 48.0 |

However, as will be apparent to those of ordinary skill in the art, mere polarity considerations are insufficient to define efficient extraction solvents for the present process. Methanol, for instance, has sufficient polarity, but its density, 0.79 g/cc, is about the same as that of a typical light oil, making separation very difficult. Other properties to consider include boiling point, freezing point, viscosity, and surface tension. Surprisingly, the combination of the properties exhibited by DMSO make it an excellent solvent for extracting oxidized sulfur and nitrogen compounds from liquid light oil, but unfortunately it contains a large proportion of sulfur. Heteroatom solvents containing nitrogen, phosphorous, and sulfur must be very volatile to ensure substantially complete stripping of the solvent from the diesel oil. The preferred solvents in this process are acetonitrile and methanol due to their polarity, volatility and relatively low cost.

In the second stage or step, the oxidized sulfur compounds are extracted in countercurrent extractor 16 of the Karr, Scheibel, or other configuration of countercurrent or stirred tank extractor to remove the oxidized sulfur compounds from the diesel oil. The extraction phase is composed of an aqueous solution containing from about 10 to about 30% water in a polar organic solvent, such as acetonitrile or methanol. The solvent selected should be sufficiently polar to be selective for polar compounds in the process of extraction.

In a third stage of the process, a stripper column is employed to remove traces of the solvent from the diesel oil. The solvent is recovered and sent to the solvent recovery fractionator 20.

In a fourth stage of the process, the extraction-rich solvent is recovered in a stripper recovery flash evaporator (not shown). Bottoms from the evaporator are purged to a sulfone storage tank to be sold as petrochemical intermediates, or added to fuel oil or crude oil.

In a fifth stage of this process, the diesel oil is passed through an adsorbent polishing column which removes the last traces of sulfur to below 10 ppm w/w from the diesel oil. Many adsorbents can be used for this purpose, including activated carbon, silica gel, alumina and other inorganic adsorbents. In a preferred embodiment of this invention, an adsorbent comprised of polar polymers coated onto inert, but high surface area supports, such as silica gel, alumina, and activated carbon is utilized. These polymers can include, among other compounds, polysulfones, polyacrylonitrile, polystyrene, polyester terepthalate, polyurethane, and other polymers which demonstrate affinity for oxidized sulfur species. The advantage of using the polymer coated onto the support is that the adsorption and desorbtion processes are rapid and reversible, the adsorbates are easily recovered, and the column is easily regenerated by extraction with a suitable solvent and drying.

EXAMPLES

Insofar as the catalyst preparations disclosed in the following examples are concerned, guidance was obtained from the following references and their respective descriptions:

1. Venturello, Carlo, et al., U.S. Pat. No. 4,562,276, Peroxide Composition Based on Tungsten and Phosphorus or Arsenic and Processes and Uses Relative Thereto, Dec. 31, 1985;
2. Bonsignore, Stefanio, et al, U.S. Pat. No. 5,324,849 Class of Peroxy Compounds Based on Tungsten and Diphoshonic Acids and Process for Obtaining Them, Jun. 28, 1994.
3. Te, Mure, et al, Oxidation Reactivities of Dibenzothiophenes in Polyoxymetalate/$H_2O_2$ and Formic Acid/$H_2O_2$Systems, Applied Catalysis A: General 219 (2001) 267-280;
4. Shum, Wilfred P. and Cooper, Charles F., U.S. Pat. No. 4,772,731 Epoxidation of Olefins with Molybdenum Dioxo Dialkyleneglycolate Compositions, Sep. 20, 1988
5. Campos-Martin, J. M., et al, Highly Efficient Deep Desulfurization of Fuels by Chemical Oxidation, Green Chemistry, 2004, 6, 556-562;
6. Hu, Changwen, Catalysis by Heteropoly Compounds XXII. Reactions of Esters and Esterifications Catalyzed by Heteropolyacids in a Homogeneous Liquid Phase, Journal of Catalysis 143, 437-448 (1993); and
7. Bressan, Mario, et al, Oxidation of Dibenzothiophene by Hydrogen Peroxide or Monopersulfate and Metal-Sulfophthalocyanine Catalysts, New Journal of Chemistry, 2003, 27, 989-993.

Example 1

A. Preparation of Catalyst: Tetraoctyl-ammonium phosphotungstate, a Carlo Venturello catalyst having the molecular formula $\{(C_8H_{17})_4N\}_3PW_4O_{24}$ (FW 2550.99), was prepared. Sodium tungstate, $Na_2WO_4{\cdot}2H_2O$, (3.30 grams, 10 mmol) was added to a 250 milliliter (mL) beaker with 7 mL of 30% aqueous hydrogen peroxide, $H_2O_2$, and stirred at 25° C. until a colorless solution was obtained. To this solution, 1.0 mL 85% phosphoric acid $H_3PO_4$ was added and the contents were diluted to 50 mL with water. To the resultant solution, 2.5 grams of tetraoctylammonium chloride (Aldrich) in methylene chloride was added dropwise while stirring over a period of about 2 minutes. Stirring was continued for an additional 15 minutes. The organic phase was then separated, filtered, and evaporated at room temperature overnight to form 3.5 grams of a colorless syrup, which is the tetraoctyl-ammonium phosphotungstate catalyst, a modified Keggin structure.

B. Oxidation of Arabian Light Gas Oil: A 100 mL sample of full range hydrotreated Arabian light gas oil containing 910 parts per million weight/volume (ppm w/v) total sulfur was heated to 85° C. with stirring on a stirring hot plate. A 50 mL portion of 15% weight/weight (w/w) hydrogen peroxide in water was added and 50 milligrams (mg) of the catalyst formed above, tetraoctyl-ammonium phosphotungstate, was added. The reaction was continued for 15 minutes after which the reactants were cooled and poured into a 250 mL separatory funnel from which the aqueous peroxide lower layer was withdrawn and discarded. A sample of the oil layer was analyzed by gas chromatography with a Sievers Sulfur Chemiluminescence Detector (GC-SCD) and compared with a sample of the original full range hydrotreated Arabian light gas oil. The chromatogram showed the presence of about the same amount of sulfur, but the sulfur peaks were displaced to later in the chromatogram, indicating the formation of sulfones. Sulfur analysis showed the oxidized sample to contain 880 ppm w/v sulfur, allowing for analytical error, indicating no removal of the sulfur.

C. Batch Extraction Of Oxidized Oil: The 100 ml sample of the oil phase prepared in step B of this Example 1 was extracted twice with 50 mL aliquots of acetonitrile containing 10% volume/volume (v/v) distilled water. After the second extraction, 98 ml of oil was recovered, and analyzed for total sulfur content. This sample was found to contain 60 ppm sulfur w/v. The oil sample was analyzed by GC-SCD and substantially all of the original and oxidized sulfur peaks were removed. The two extracts were combined and were evaporated overnight to a dry oil, which was then analyzed by gas chromatography-mass spectrometry (GCMS) and GC-SCD. The GC-SCD indicated the presence of the alkylbenzothiophene-dioxides and alkyldibenzothiophene-dioxides that were originally present in the oxidate oil. GCMS results indicated the presence of methyl, dimethyl, trimethyl, and tetramethyl benzothiophene sulfones and dibenzothiophene sulfones.

D. Countercurrent Extraction Of Oxidized Oil: A 100 mL sample of full range hydrotreated Arabian light gas oil containing 910 ppm w/v of total sulfur was oxidized as in step B of this Example 1, but was not extracted. The 100 mL sample of oxidized oil containing approximately 900 ppm w/v sulfur, as sulfones, was transferred to a 2.5 cm by 75 cm fritted countercurrent extraction apparatus containing 50 cm of 3 mm diameter glass beads. A Hitachi L2000 laboratory pump was used to pump 150 ml solution of acetonitrile: water 90:10 v/v at 10 mL/min upward through the frit and the oxidized oil. After countercurrent extraction with the mixed polar solvent, the oil was withdrawn from the extraction apparatus and analyzed by GC-SCD and for total sulfur. No sulfur peaks were detected in the extracted oil, and total sulfur analysis gave a value of 25 ppm w/v.

E. Polishing Of Extracted Oxidized Oil With Solid Phase Adsorbent Media: A 100 mL sample of full range hydrotreated Arabian light gas oil containing 910 ppm w/w of total sulfur was oxidized and extracted as described in steps B and C of this Example 1. The sample of oxidized and extracted oil was passed through a 2.5 cm diameter by 50 cm high fritted chromatography column containing 10 grams of Millipore Cyano Bonded solid phase extraction media. The effluent from the column was analyzed by GC-SCD and found to contain no detectable sulfur peaks. Sulfur analysis by the Antek total sulfur analysis method gave a result of 8 ppm w/v.

F. Polishing Oxidized Extracted Oil by Alumina: The 100 mL sample of oxidized and extracted oil prepared in step D of this Example 1, was passed through a 2.5 cm diameter by 50 cm high fritted chromatography column containing 10 grams of Davidson Alumina. The effluent from the column was analyzed by GC-SCD and found to contain no detectable sulfur peaks. Sulfur analysis by the Antek total sulfur analysis method gave a result of 5 ppm w/v.

Example 2

A. Preparation of Catalyst: Molybdotungstic trisphosphonate, a Stefanio Bonsignore catalyst having the molecular formula $Mo_2W_7O_{30}\cdot 2N(CH_2PO)_3$ (FW 2217.75), was prepared. To a 250 mL beaker containing 100 mL distilled water was added 3.54 grams $(NH_4)_6Mo_7O_{24}\cdot 4H_2O$ (FW 1235.86) and 23.10 grams $Na_2WO_4\cdot 2H_2O$ (FW 329.86). The solution contained 20 meq of molybdenum and 70 meq of tungsten and was stirred vigorously for 15 minutes until the solution became clear and colorless, after which 3 mL of the solution was transferred to a 20 mL vial. A quantity of 1.0 mL of 30% hydrogen peroxide was added and mixed until a wine-red color developed, indicating a molybdotungstate polyoxymetalate. A quantity of 2.00 mL of a 30% (1.0 M) solution (2.0 millimole) of amino-tris-methylenephosphonic acid (ATMP), $N(CH_2PO_3H_2)_3$ (MW 299.05) was added, and the solution quickly turned greenish-yellow, forming molybdotungstic trisphosphonate, a modified Dawson structure.

B. Oxidation and Analysis of Oil: To a 400 mL beaker, 100 mL of full range hydrotreated straight run diesel was added, 50 mL of 15% hydrogen peroxide was added, and 25 mg of tetradecyl ammonium aromide (TDAB) was added as a phase transfer catalyst; the mixture was heated and stirred. A quantity of 5.0 mL of the prepared peroxo-molybdotungstate trisphosphonate catalyst was added to the oil-water-peroxide mixture and the mixture heated to 80° C. and maintained at between 80° C. and 100° C. for 40 minutes.

The oxidized mixture was cooled and transferred to a 250 mL separatory funnel. The lower aqueous layer was separated and discarded, and the oil layer was transferred to a 200 mL polyethylene bottle. A sample of the oil was analyzed by a Sievers GC-SCD. All of the sulfur peaks were shifted to the sulfone region of the chromatogram indicating an apparent conversion of 100%.

Example 3

A. Preparation of Catalyst: Molybdophosphoric acid, a Mere Te catalyst having the molecular formula $H_3PO_4Mo_{12}O_{36}\cdot XH_2O$ (FW1825.25), was prepared. Two grams of molybdic acid (Fisher $MoO_3$ 89.1%) was weighed into a 400 mL beaker and 40 mL of distilled water and NaOH pellets (0.25 grams) were added and the mixture was stirred to form a solution. Two grams of ammonium paramolybdate $(NH_4)_6Mo_7O_{24}\cdot 4H_2O$) was added and swirled with NaOH pellets (0.5 grams). This mixture was stirred for 10 minutes until all solids dissolved after which 5.0 ml of 85% phosphoric acid was added and stirring continued. Thereafter 3.0 ml of concentrated nitric acid was added with continuous stirring. The solution of dodecamolybdophosphoric acid, a Keggin structure, exhibited a very faint yellow tinge.

B. Oxidation and Analysis of Oil: To a 400 mL beaker 100 mL of hydrotreated diesel and 50 mL of 15% hydrogen peroxide were added. Two mL of the dodecamolybdophosphoric acid catalyst solution prepared above was added while stirring, as the sample was heated; 50 mg of hexadecylpyridinium chloride (Aldrich) was added, and the solution was heated to 80° C. and maintained at between 80° C. and 100° C. with vigorous stirring for 30 minutes. The sample was cooled and transferred to a 250 mL separatory funnel from which the lower aqueous layer was removed and discarded.

The oil was transferred to a 200 mL polyethylene bottle and a sample analyzed by a Sievers GC-SCD. Approximately 20% of the sulfur peaks shifted to later retention times, indicating oxidation of benzothiophenes and dibenzothiophenes to their respective sulfones.

Example 4

A. Preparation of Catalyst: Triphosphono-polyperoxotungstate, a J. M. Campos-Martin catalyst having the molecular formula $N(CH_2PO)_3(WO_5)_9$ (FW 2571.54), was prepared. Sodium tungstate $Na_2WO_4 \cdot 2H_20$ (3.0 grams) was dissolved in 10 mL of 30% hydrogen peroxide to form a bright yellow solution. Three mL of a 30% solution of amino (tris) methylenephosphonic acid $(N(CH_2PO_3H_2)_3$ was added. The solution turned colorless immediately. Triphosphono-polyperoxotungstate, a modified Lindqvist structure, was formed. This solution was diluted to 30 mL with distilled water.

B. Oxidation and Analysis of Oil: To a 400 mL beaker 100 mL of hydrotreated diesel and 50 mL of 15% hydrogen peroxide were added. Two mL of the triphosphono-polyperoxotungstate catalyst solution prepared above was added while stirring as the sample was heated; 50 mg of hexadecyltrimethyl ammonium bromide was added, and the solution was heated to 80° C. and maintained at between 80° C. and 100° C. with vigorous stirring for 30 minutes. The sample was cooled and transferred to a 250 mL separatory funnel and the lower aqueous layer was removed and discarded.

The oil was transferred to a 200 mL polyethylene bottle, and a sample analyzed by a Sievers GC-SCD. Approximately 90% of the sulfur peaks shifted to later retention times, indicating oxidation of benzothiophenes and dibenzothiophenes to their respective sulfones.

Example 5

A. Preparation of Catalyst: Bismuthomolybdic acid, a Changwen Hu catalyst having the molecular formula $H_5BiMo_{12}O_{40} \cdot 4H_2O$ (FW 2077.34), was prepared. A quantity of 2.0 grams bismuth nitrate, $Bi(NO_3)_2$, was dissolved in 50 mL of distilled water in a 250 mL beaker, to which concentrated nitric acid was added dropwise until a first solution was formed. Separately, a quantity of 25.0 grams of ammonium paramolybdate, $(NH_4)_6Mo_7O_{24}$, was weighed into a 400 mL beaker and was dissolved in 150 mL distilled water with vigorous stirring. A white precipitate formed immediately and was aged at 50° C. for 6 hours. The product was filtered, washed with distilled water, then dried overnight. The precipitate was formed into a powder mixed with the first solution, and calcined for 12 hours at 450° C. to from a bismuthomolybdic acid compound, which is an Anderson structure.

B. Oxidation and Analysis of Oil: To a 400 mL beaker 100 mL of hydrotreated diesel and 50 mL of 15% hydrogen peroxide were added, along with 100 mg of the bismuthomolybdic acid catalyst, with stirring as the sample was heated. Thereafter, 50 mg of tetraoctyl ammonium bromide was added and the solution was heated to 80° C. and maintained at between 80° C. and 100° C. with vigorous stirring for 30 minutes. The sample was cooled and transferred to a 250 mL separatory funnel and the lower aqueous layer was removed and discarded.

The oil was transferred to a 200 mL polyethylene bottle, and was analyzed by a Sievers GC-SCD. At least 95% of the sulfur peaks shifted to later retention times, indicating oxidation of benzothiophenes and dibenzothiophenes to their respective sulfones.

Example 6

A. Preparation of Catalyst: Sodium sulfophthalocyanine cobalt peroxide, a Mario Bressan catalyst having the molecular formula $Na_4C_{32}H_{12}N_8S_4O_{12}Co(II)O_2$ (FW 1011.64), was prepared. A 0.50 g quantity of commercial UOP cobalt sulfophthalocyanine (Merox catalyst) was dissolved in 100 mL 10% NaOH to prepare a 5000 ppm stock catalyst solution and 4.0 mL of the stock catalyst solution was added to 36 mL of an aqueous solution of 3.8625% potassium monopersulfate, $KHSO_5$ (0.25 Molar) from Mallinkrodt. The catalyst solution, sodium sulfophthalocyanine cobalt peroxide, which is a substituted porphyrin molecule, was placed in a vial until used for oxidation. Final concentrations of the catalyst solution are 500 ppm of cobalt sulfophthalocyanine and 0.225 M in potassium monopersulfate.

B. Oxidation and Analysis of Oil: To 100 mL of hydrotreated diesel in a 500 mL Erlenmeyer flask fitted with a condenser, 40 mL of the sodium sulfophthalocyanine cobalt peroxide—monopersulfate solution and 60 mL of acetonitrile were added, with stirring as the sample was heated. The mixture was heated to 83° C. and maintained at between 80° C. and 100° C. with total reflux and vigorous stirring for 3 hours. The sample was cooled at 5° C. for two hours, after which the contents of the Erlenmeyer flask were transferred to a 250 mL separatory funnel, and the lower aqueous acetonitrile layer was removed and discarded. The remaining oil was transferred to a 200 mL polyethylene bottle and was analyzed by a Sievers GC-SCD. Approximately 50% of the sulfur peaks were removed from the oil and some were shifted to later retention times, indicating oxidation of benzothiophenes and dibenzothiophenes to their respective sulfones. Approximately half of the sulfur was removed from the oil by dissolution in the aqueous acetonitrile layer.

Those skilled in the art will recognize, or be able to ascertain using no more than routine experimentation, many equivalents to the specific embodiments of the invention described herein. These and all other such equivalents are intended to be encompassed by the following claims.

The invention claimed is:

1. A process for reducing the sulfur content of hydrocarbon mixture containing sulfur compounds comprising:

a. contacting the hydrocarbon mixture with an oxidant in a reactor in the presence of a catalyst that includes Anderson structure molecules for a period of time sufficient to oxidize at least a portion of the sulfur compounds in the hydrocarbon mixture; and b. removing the oxidized sulfur compounds from the hydrocarbon mixture by a countercurrent liquid-liquid extraction with an aqueous solution of polar solvent.

2. The process of claim 1, including the steps of:

c. stripping the solvent from the hydrocarbon mixture; and d. polishing the hydrocarbon mixture by passing it through an adsorbent to remove any remaining sulfur compounds.

3. The process of claim 1, wherein the reactor is a countercurrent reactor.

4. The process of claim 1, wherein the reactor is stirred, agitated, oscillated, or static.

5. The process of claim 1, wherein the solvent is selected from the group consisting of aqueous solutions of acetonitrile and methanol.

6. The process of claim 2, wherein the polishing is by passing the hydrocarbon mixture through an adsorbent bed that includes polar organic groups coated on or bound to a support selected from silica, alumina, and carbon.

7. The process of claim 1, further comprising contacting the hydrocarbon mixture with a co-catalyst as a phase transfer agent.

8. The process of claim 1, wherein the hydrocarbon mixture is diesel fuel.

9. The process of claim 8, wherein the diesel fuel is hydrotreated diesel containing less than about 1000 ppm by weight of sulfur.

10. The process of claim 1, wherein the Anderson structure compounds comprise bismuthomolybdic acid.

11. The process of claim 1, wherein the Anderson structure compounds comprise bismuthomolybdates.

12. The process of claim 1, wherein the Anderson structure compounds comprise tetraalkylammonim polyoxometallates.

13. The process of claim 1, wherein the Anderson structure compounds comprise quaternary ammonium salts of polyoxometallates.

14. The process of claim 1, wherein the Anderson structure compounds comprise poly oxy metalates.

* * * * *